United States Patent [19]

Ohishi et al.

[11] Patent Number: 4,538,425

[45] Date of Patent: Sep. 3, 1985

[54] INTEGRAL TYPE AIR CONDITIONING DEVICE

[75] Inventors: Kenji Ohishi, Yaizu; Yasuhiko Hashimoto, Fujieda, both of Japan

[73] Assignee: Mitsubishi Denki Kabushiki Kaisha, Tokyo, Japan

[21] Appl. No.: 546,463

[22] Filed: Oct. 28, 1983

[30] Foreign Application Priority Data

| | | | |
|---|---|---|---|
| Oct. 29, 1982 | [JP] | Japan | 57-190245 |
| Nov. 4, 1982 | [JP] | Japan | 57-193870 |
| Nov. 4, 1982 | [JP] | Japan | 57-193871 |

[51] Int. Cl.[3] ..... F25B 47/00

[52] U.S. Cl. ..... 62/280; 62/272

[58] Field of Search ..... 62/272, 280, 279

[56] References Cited

U.S. PATENT DOCUMENTS

| | | | |
|---|---|---|---|
| 2,793,510 | 5/1957 | Komroff et al. | 62/280 |
| 2,982,110 | 5/1961 | Kramer | 62/280 |

FOREIGN PATENT DOCUMENTS

| | | |
|---|---|---|
| 960122 | 6/1964 | United Kingdom . |

*Primary Examiner*—Henry Bennett

*Attorney, Agent, or Firm*—Oblon, Fisher, Spivak, McClelland & Maier

[57] ABSTRACT

An integral type air conditioning device has a refrigerator in a room interior side which is defined by a partition plate. Drain water condensed by the refrigerator is led to a room exterior side of the air conditioning device to be splashed onto a condenser for evaporation by a slinger ring formed integrally with a propeller fan. There are provided in the air conditioning device a fan cover to form a room exterior air course with said condenser and said propeller fan arranged on a base member and inhibiting means formed integrally with, or attach to, said fan cover to prevent drain water drops splashed by said slinger ring from dropping onto said propeller fan.

5 Claims, 5 Drawing Figures

INTEGRAL TYPE AIR CONDITIONING DEVICE

BACKGROUND OF THE INVENTION

1. Field of the Invention

This invention relates to an integral type air conditioning device of a construction, in which the main body of the air conditioning device is divided by a partition plate into a room interior side and a room exterior side. More particularly, the present invention is concerned with improvement in a drain water splashing device for such integral type air conditioner, which can be attained by slide-insertion of the air conditioner main body into an outer casing, and then fitting a front panel onto the face of this outer casing to complete the entire construction.

2. Description of the Prior Art

The drain water splashing device for this kind of integral type air conditioning device is so designed that the drain water which has been condensed by a refrigerator at the room interior side of the air conditioning device during its cooling operation is collected into a drain pan, then led to a lower part of a propeller fan at the room exterior side thereof, and splashed by a slinger ring formed integrally with the propeller fan to collide with a condenser for evaporation to thereby increase the condensing efficiency due to heat which is deprived of the condenser at the time of the evaporation. However, the splash of the drain water impinges not only against the condenser, but also against both side surfaces and the top surface of the fan cover. In particular, the drain water which has splashed on the top surface of the fan cover grows little by little into large water drops, and finally falls on the rotating propeller fan. At the time of this droppage, abnormal metallic sound such as clanging sound is produced, continued production of which would give considerable annoyance to the ears of users, hence causing complaints.

SUMMARY OF THE INVENTION

It is therefore an object of the present invention to provide an integral type air conditioning device, from which the above-described disadvantages inherent in the conventional integral type air conditioner have been removed, and in which improvement has been made on the construction of the drain water splashing device in a manner to lead the splashed drain water to a condenser with good efficiency by means of a slinger ring.

It is another object of the present invention to provide an improved integral type air conditioner of a construction, in which the top surface of the fan cover is formed in such a way that it may be inclined downward as it extends toward the condenser, whereby the drain water splashed by the slinger ring and adhered to the top surface of the fan cover can be led to the condenser without its droppage on the propeller fan, thus serving to increase in the operation capacity of the device.

It is still another object of the present invention to provide an improved integral type air conditioner, which eliminates abnormal sound to be produced by drain water drops falling from the top surface of the fan cover and impinging against the propeller fan at the time of the drain water splash to take place in the air conditioning device of a construction, wherein the main body of the device is divided by a partition plate into the room interior side and the room exterior side, and then this main body is arranged on a base member to constitute an air conditioning unit.

It is other object of the present invention to provide an improved integral type air conditioning device of a construction, in which a semi-circular drain guide is attached to the top surface of the fan cover so as to cause the drain water, which has been splashed to this part and is liable to produce the abnormal sound, to drop from the rightmost part of the drain guide onto the base member before it grows into large water drops, thereby eliminating the drain water to drop on the propeller fan.

According to the present invention in general aspect of it, there is provided an integral type air conditioning device of a construction, in which a main body of said air conditioning device is divided by a partition plate into a room interior side and a room exterior side, and drain water condensed by a refrigerator at the room interior side is led to the room exterior side to be splashed onto a condenser for evaporation by a slinger ring formed integrally with a propeller fan, wherein improvement comprises a fan cover forming a room exterior air course together with said condenser and said propeller fan arranged on a base member; and inhibiting means formed integrally with, or attached to, said fan cover to prevent drain water drops splashed by said slinger ring from dropping onto said propeller fan.

BRIEF DESCRIPTION OF THE DRAWINGS

The foregoing objects, other objects as well as specific construction and operations of the integral type air conditioning device according to the present invention will become more apparent and understandable from the following detailed description thereof, when read in conjunction with the accompaning drawing.

In the drawing.

Figure 1:
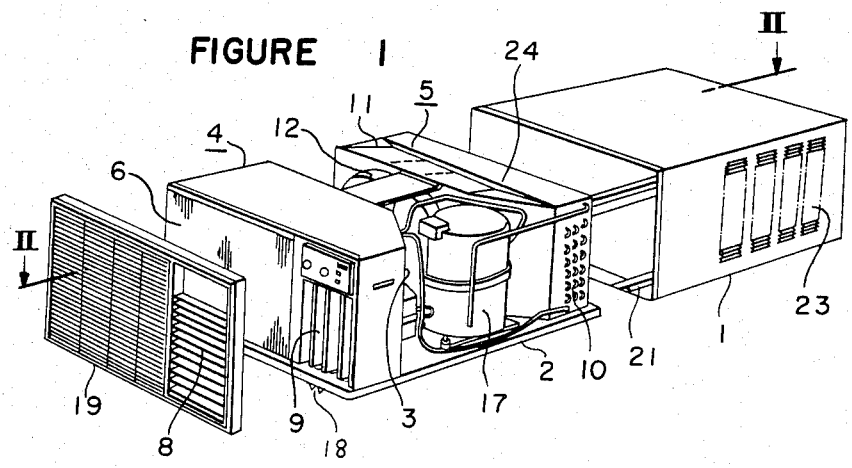
FIG. 1 is an exploded perspective view of an integral type air conditioner according to a preferred embodiment of the present invention.
Figure 2:
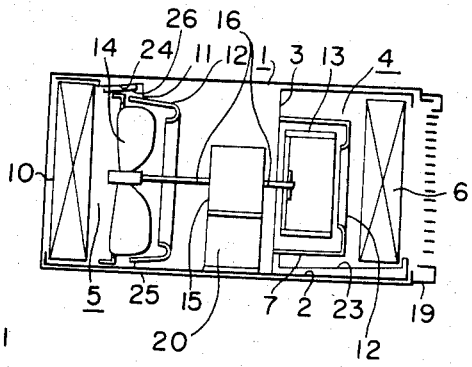
FIG. 2 is a longitudinal cross-sectional view of the air conditioning device shown in FIG. 1, taken along a line II—II.
Figure 3:
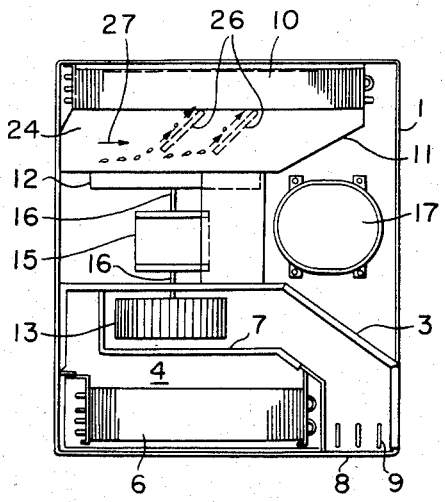
FIG. 3 is a top plan view of the air conditioning device according to the present invention.

In the following, the present invention will be explained in detail in reference to FIGS. 1 to 3 showing the first embodiment of the present invention.

DETAILED DESCRIPTION OF THE PREFERRED EMBODIMENTS

A reference numeral 1 designates a main body casing for the integral type air conditioning device having a base member 2, on which a partition plate 3 is erected to form a unit installing section defining a room interior side 4 and a room exterior side 5. A numeral 20 refers to a motor bed to fixedly hold thereon an electric motor 15 for blowing air. The motor bed is fixedly secured to the base member 2. A numeral 6 refers to a refrigerator which is disposed at the front face of the room interior side 4 of the unit installing section in the main body casing 1. A reference numeral 7 denotes a casing provided at the back side of the refrigerator 6. The casing is communicatively connected with an air outlet port 8, thereby forming a room interior side air course together with the partition plate 3. A numeral 9 refers to wind direction adjusting vanes provided at the air outlet port 8. A reference numeral 19 represents a front panel having the air outlet port 8 and provided in front of the refrigerator 6. A reference numeral 10 denotes a condenser which is placed in the room exterior side. There is formed an air course from louvers 23 of the main body casing 1 through a fan cover 11, which is provided with a bellmouth 12 and surrounds the condenser 10, to the condenser 10. A numeral 24 indicates an inclined surface provided on the top surface of the fan cover 11, which is bent downward toward the condenser 10. A reference numeral 13 desingates a sirocco fan disposed at the room interior side 4. A numeral 14 refers to a propeller fan, which is formed integrally with a slinger ring and is disposed at the room exterior side 5. One or a plurality of guides 26 are formed on the under side of the inclined surface 24, either integrally with, or attached as a separate member to, the inclined surface in a manner to follow the flow of the drain water and guide the drain water toward the condenser 10. At both ends of a rotational shaft 16 of the air blowing electric motor 15, there are fixedly supported the above-mentioned sirocco fan 13 and the propeller fan 14. A reference numeral 17 designates a compressor provided at the room exterior side 5. A numeral 18 refers to a pair of rail grooves to be engaged with a pair of corresponding rails 21 provided inside the main body casing 1, by means of which the base member 2 is slid into the casing 1, followed by fitting of the front panel 19 to the casing, thereby completing the installation of the air conditioning unit.

In the following, explanations will be given as to the operations of the air conditioning device according to this first preferred embodiment of the invention.

When the air conditioner is operated, moisture in air of a room interior is condensed and collected into a drain pan 23 beneath the refrigerator 6. It then passes through grooves (not shown in the drawing) formed in the base member 2 and flows toward the room exterior side 5 of the unit installing section to stay underneath the propeller fan 14. Since the propeller fan 14 has the slinger ring 25 integrally formed therewith, the drain water is lifted upward by the rotation of the propeller fan 14, impinges against the upper part of the fan cover 11, and runs in the direction of an arrow 27 in FIG. 3, while flowing along the top part of the fan cover 11. Since the fan cover 11 is downwardly inclined toward the condenser 10 and a plurality of guides 26 are also attached to the condenser 10 in a manner to deflect the flow of the drain water to the side of the condenser 10, the drain water 28 which collides with the fan cover 11 and flows on and along the top surface of the fan cover flows down into the condenser 10 without its dropping on the propeller fan.

Since the drain water disposing device according to the above-described embodiment of the present invention is so constructed that the top surface of the fan cover 11 is inclined downward toward the condenser 10 and one or more guides 26 are provided on this inclined surface 14 so as to guide the drain water to the condenser 10, the water drops adhered onto the top surface of the fan cover 11 effectively flow down into the condenser 10, and no abnormal sound whatsoever is produced from droppage of the drain water drops onto the propeller fan 14, hence the condensing efficiency can also be improved, and various other advantages. Therefore, the effects to be derived from the present invention are remarkable. Further, since this inclined surface 24 can be formed as an integral part of the fan cover 11, the manufacturing cost of the device is kept low and the effects in the practical use of the device are remarkable. It is, of course, possible that the inclined surface 24 be constructed as a separate member.

In the following, the second embodiment of the present invention will be explained in reference to FIGS. 4 and 5.

This embodiment is of such a construction that the splashed drain water is guided to the outer side of the propeller fan so as not to drop on the propeller fan. In the drawing, the same reference numerals as those in FIGS. 1 to 3 designate identical or equivalent parts.

In this second embodiment of the present invention, the fan cover 11A which corresponds to the fan cover 11 shown in FIGS. 1 to 3, is provided with a drain guide 40 to guide water drops 42 from the splashed drain water, to the outer side of the propeller fan 14. For this purpose, the fan cover 11A does not incline toward the condenser 10. The water drain guide 40 is in a semi-circular shape with its center part being fixedly secured to the top surface of the fan cover 11A, as shown in FIG. 5. Incidentally, the fan cover 11A may, of course, be constructed same as the fan cover 11 shown in FIGS. 1 to 3 without raising any problem.

In the following, explanations will be given as to the operations of the air conditioning device shown in FIGS. 4 and 5. By the slinger ring 25 rotating with rotation of the electric motor 15, the drain water 41 is splashed. The splashed drain water 41 is mainly scattered to the side of the condenser 10 by the rotating propeller fan 14, while the drain water 41 adhered to the outer peripheral surface of the slinger ring 25 is also scattered in the circumferential direction of the propeller fan in an atomized form. Thus, of the scattered drain water, the atomized drain water scattered to the side of the fan cover 11A adheres onto the inner peripheral surface of the water drain guide 40, and grows into large water drops 42 gradually with lapse of time.

On the other hand, those water drops 42 which have grown to such a degree that are not able to drop are caused to move to the right end of the drain guide due to air current created inside the drain guide 40 with rotation of the slinger ring 25, and pushing this water drops along the inner wall of the drain guide 40. The water drops 42 which have moved up to the right end further grow into large size and drop onto the base member 2 without their dropping onto the propeller fan 14.

This second embodiment of the present invention is constructed as mentioned in the foregoing, and aims at eliminating the abnormal sound to be produced at the time of the drain water splashing in the air conditioning device constructed in unit, wherein the main body of the air conditioner is divided by the partition plate into the room interior side and the room exterior side of the unit installing section which is then arranged on the base member, and wherein the drain water drops from the top surface of the fan cover onto the propeller fan giving out such abnormal sound. To attain this objective, the second embodiment of the present invention provides a semi-circular water drain guide on the top surface of the fan cover, to thereby drop the drain water in the form of very small drops scattered to this portion from the right end of the water drain guide due to wind pressure created by the propeller fan before it grows into large drops. This can be achieved merely by adding a simple component part to the existing conventional air conditioning device, so that the merit to be derived from the present invention is very remarkable.

Figure 4:
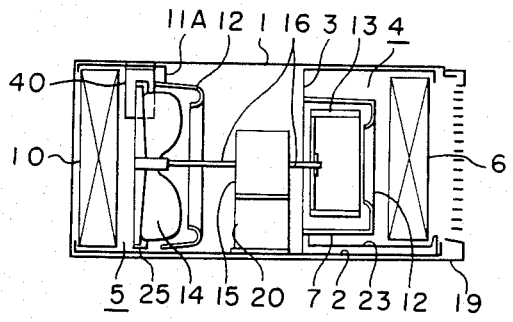
FIG. 4 is a longitudinal cross-sectional view, similar to that in FIG. 2, showing another embodiment of the air conditioning device according to the present invention.
Figure 5:
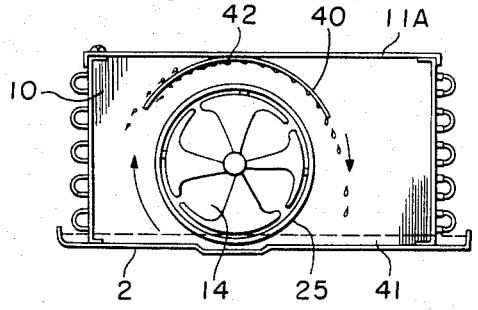
FIG. 5 is a front view showing the main part of the integral type air conditioning device according to the second embodiment of the present invention shown in FIG. 4.

By the way, it may become possible that further effect is obtainable by combination of this second embodiment shown in FIGS. 4 and 5 and the first embodiment shown in FIGS. 1 to 3.

Although, in the foregoing, the present invention has been described with reference to particular embodiments thereof, it should be noted that they are merely illustrative and not so restrictive, and that any changes and modifications may be made by those persons skilled in the art within the spirit and scope of the present invention as set forth in the appended claims.

We claim:

1. An integral type air conditioning device having a main body which is divided by a partition plate into a room interior side and a room exterior side and whereby drain water condensed by a refrigerator at the room interior side is fed to the room exterior side to the splashed onto a condenser for evaporation by a slinger ring formed integrally with a propeller fan wherein said device further comprises:

a fan cover to form a room exterior air course together with said condenser and said propeller fan arranged on a base member; and inhibiting means attached to said fan cover, said inhibiting means including a semi-circular water drain guide to prevent drain water drops splashed by said slinger ring from dropping onto said propeller fan and to cause a portion of said drain water drops splashed by said slinger ring to drop onto said base member on said room exterior side of said device.

2. The device according to claim 1, wherein said inhibiting means further includes a means formed integrally with said fan cover in such a manner that an inclined surface may be formed on the top surface of said fan cover to permit the drain water drops to flow toward said condenser.

3. The device according to claim 2, wherein one or a plurality of drain guides are provided on the lower side of said inclined surface, either being integrally formed with, or attached, as a separate member, to, the inclined surface.

4. The device according to claim 1, wherein said inhibiting means further comprises, inside the top surface of said fan cover, a member having an inclined surface, along which the drain water drops flow toward said condenser.

5. The device according to claim 4, wherein one or a plurality of drain guides are provided on the lower side of said inclined surface, either being integrally formed with, or attached, as a separate member, to, the inclined surface.

* * * * *